US008106935B2

(12) United States Patent
Watanabe

(10) Patent No.: US 8,106,935 B2
(45) Date of Patent: Jan. 31, 2012

(54) OPTICAL SCANNING APPARATUS AND IMAGE FORMING APPARATUS INCLUDING SAME

(75) Inventor: Kazunori Watanabe, Tama (JP)

(73) Assignee: Ricoh Company, Ltd., Tokyo (JP)

( * ) Notice: Subject to any disclaimer, the term of this patent is extended or adjusted under 35 U.S.C. 154(b) by 801 days.

(21) Appl. No.: 12/216,186

(22) Filed: Jul. 1, 2008

(65) Prior Publication Data

US 2009/0009826 A1 Jan. 8, 2009

(30) Foreign Application Priority Data

Jul. 2, 2007 (JP) ..... 2007-174453

(51) Int. Cl.
*B41J 2/435* (2006.01)

(52) U.S. Cl. ..... 347/245; 347/263

(58) Field of Classification Search ..... 347/238, 347/241–245, 256–258, 263
See application file for complete search history.

(56) References Cited

U.S. PATENT DOCUMENTS

| | | | | |
|---|---|---|---|---|
| 7,777,775 | B2 * | 8/2010 | Kuribayashi | 347/242 |
| 2007/0104076 | A1 * | 5/2007 | Nakagawa et al. | 369/122 |
| 2007/0122192 | A1 * | 5/2007 | Yamakawa et al. | 399/151 |

FOREIGN PATENT DOCUMENTS

| | | |
|---|---|---|
| JP | 2003-266787 | 9/2003 |
| JP | 3681555 | 5/2005 |
| JP | 2007-144952 | 6/2007 |

OTHER PUBLICATIONS

English language abstract of JP 2000-098278 dated Apr. 7, 2000.

* cited by examiner

*Primary Examiner* — Hai C Pham
(74) *Attorney, Agent, or Firm* — Harness, Dickey & Pierce, P.L.C.

(57) ABSTRACT

An optical scanning apparatus includes a light source configured to emit a light beam which scans an object to be scanned, a light source retainer configured to retain the light source, a holder including an engaging portion and configured to detachably hold the light source retainer in an optical axis direction of the light source, and a first biasing member configured to bias the light source retainer engaging the engaging portion against the engaging portion in a direction perpendicular to the optical axis direction, so that the light source retainer is pressed against the engaging portion. A contact position of the light source retainer and the first biasing member in the optical axis direction is within an engaging area where the engaging portion and the light source retainer engage in the optical axis direction.

20 Claims, 11 Drawing Sheets

OPTICAL SCANNING APPARATUS AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2007-174453 filed on Jul. 2, 2007 in the Japan Patent Office, the entire contents of which is hereby incorporated herein by reference.

BACKGROUND OF THE INVENTION

1. Field of the Invention

Exemplary aspects of the present invention generally relate to an optical scanning apparatus and an image forming apparatus including the same, and more particularly, to an optical scanning apparatus which optically scans an object by using a light beam emitted from a light source such as a laser diode, and an image forming apparatus including the same.

2. Description of the Background Art

An optical scanning apparatus optically scans an object such as a photoreceptor or the like by using a light beam emitted from a light source, for example, a laser diode. This type of optical scanning apparatus, as disclosed for example in Japanese Patent Unexamined Application No. 2007-144952, has been known.

FIG. 15 is a side view illustrating a light source retainer of such an optical scanning apparatus. In FIG. 15, an LD unit 202 including a laser diode 201 (hereinafter referred to simply as LD) serving as the light source is mounted on an outer side surface 203 of a housing of the optical scanning apparatus. The LD 201 is press-fitted into an insertion hole provided to the LD unit 202 such that the optical beam can be emitted from a front side which is a plane of FIG. 15 toward a rear side. In FIG. 15, a direction perpendicular to the plane of FIG. 15 is an optical axis.

In FIG. 15, a circular opening, not shown, is formed at a portion of the housing side surface 203 behind the LD unit 202. Surrounding the circular opening is provided a cylindrical engaging portion disposed so as to protrude from the rear side of the plane of FIG. 15 to the front side.

A circular recessed portion, not shown, which engages the cylindrical engaging portion is provided to a surface of the LD, unit 202 facing the housing side surface 203. The circular recessed portion engages the cylindrical engaging portion of the housing side surface 203 so that the housing 203 holds the LD unit 202 in place.

The light beam emitted from the LD 201 in the above-described configuration enters the housing through the circular opening of the housing side surface 203. Subsequently, the light beam arrives at a surface of an object to be scanned, in this case a photoreceptor, via a polygon mirror, a focusing lens, and a reflective mirror, and so forth.

In such a configuration, in an effort to enable the outer peripheral surface of the cylindrical engaging portion of the housing to smoothly fit into the inner peripheral surface of the circular recessed portion of the LD unit 202, a small clearance is provided between the cylindrical engaging portion and the circular recessed portion. However, once so engaged, if the LD unit 202 rattles within the clearance, the optical scan position of the optical beam emitted from the LD 201 may fluctuate.

In an attempt to solve the above problem, a leaf spring 204 is provided to prevent the LD unit 202 from rattling. The leaf spring 204 is provided to bias the LD unit 202 in a direction perpendicular to the optical axis so that the circular recessed portion of the LD unit 202 is pressed against the cylindrical engaging portion of the housing side surface 203.

However, according to this configuration, leaf spring 204 manufacturing and/or installation error may cause the contact surface of the leaf spring 204 contacting the LD unit 202 to shift slightly away from the optical axis. Consequently, a force which causes the LD unit 202 to shift away from the optical axis is applied to the LD unit 202. As a result, a slight displacement of the position of the LD unit 202 occurs, causing the optical axis of the light beam emitted from the LD 201 to shift accordingly, so that precise optical scanning is difficult to perform.

SUMMARY OF THE INVENTION

In view of the foregoing, exemplary embodiments of the present invention provide an optical scanning apparatus capable of reducing, if not preventing entirely, unintended shifting of an optical axis of a light beam, and an image forming apparatus including the optical scanning apparatus.

In one exemplary embodiment, an optical scanning apparatus includes a light source, a light source retainer, a holder, and a first biasing member. The light source is configured to emit a light beam which scans an object to be scanned. The light source retainer is configured to retain the light source. The holder includes an engaging portion and is configured to detachably hold the light source retainer in an optical axis direction of the light source. The first biasing member is configured to bias the light source retainer engaging the engaging portion against the engaging portion in a direction perpendicular to the optical axis direction so that the light source retainer is pressed against the engaging portion. A contact position of the light source retainer and the first biasing member in the optical axis direction is configured to be within an engaging area where the engaging portion and the light source retainer engage in the optical axis direction.

Another exemplary embodiment provides an image forming apparatus for forming an image. The image forming apparatus includes a latent image bearing member, a developing unit, and the optical scanning apparatus described above. The latent image bearing member is configured to bear a latent image thereon. The developing unit is configured to develop the latent image on the latent image bearing member. The optical scanning apparatus is configured to form the latent image on the latent image bearing member by optically scanning the surface of the image bearing member. The optical scanning apparatus includes the light source, the light source retainer, the holder, and the first biasing member. The contact position of the light source retainer and the first biasing member in the optical axis direction is configured to be within an engaging area where the engaging portion and the light source retainer engage in the optical axis direction.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
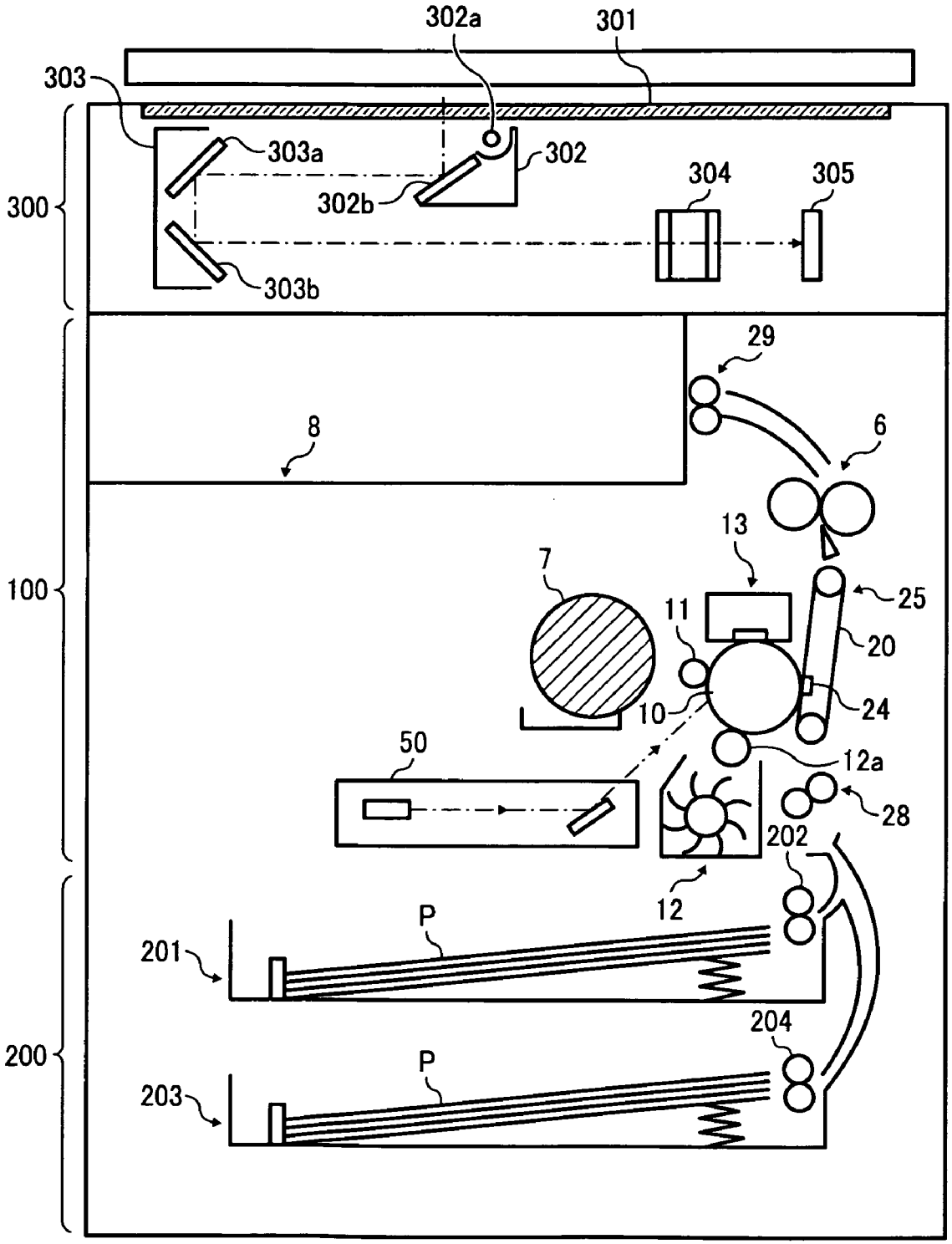
FIG. 1 is a schematic diagram illustrating an image forming apparatus, for example, a copier, according to an exemplary embodiment of the present invention.

Exemplary embodiments of the present invention are now described below with reference to the accompanying drawings.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

In a later described comparative example, exemplary embodiment, and alternative example, for the sake of simplicity of drawings and descriptions, the same reference numerals will be given to constituent elements such as parts and materials having the same functions, and redundant descriptions thereof will be omitted unless otherwise stated.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus using an electrophotographic method, for example, a copier, according to an exemplary embodiment of the present invention is described, together with the electrophotographic method of operation.

FIG. 1 is a schematic diagram illustrating an image forming apparatus, for example, a copier, according to the exemplary embodiment. In FIG. 1, the image forming apparatus includes at least a printer unit 100, a sheet feed unit 200, a scanner 300, and so forth.

The printer unit 100 includes at least a photoreceptor 10 serving as a latent image bearing member, a charger 11, a developing unit 12 serving as a developing mechanism, a cleaning unit 13 configured to clean the photoreceptor 10, and an optical scanning unit 50 configured to write an electrostatic latent image on the photoreceptor 10.

On a side of the photoreceptor 10 are provided a transfer conveyance unit 25 and a toner bottle 7 configured to store toner to be supplied to the developing unit 12. The transfer conveyance unit 25 includes a plurality of rollers which stretchedly holds and moves an endless sheet conveyance endlessly in a clockwise direction in FIG. 1.

Furthermore, the printer unit 100 includes a fixing unit 6, a pair of sheet discharge rollers 29, a sheet stack unit 8 disposed at the upper surface of the printer unit 100, and so forth. The fixing unit 6 is configured to fix a toner image onto a recording sheet P. The pair of the sheet discharge rollers 29 is configured to discharge the recording sheet P out of the image forming apparatus after the image is fixed on the recording sheet P.

The sheet feed unit 200 is provided at the bottom the printer unit 100 and includes a first sheet cassette 201, a first sheet feed roller 202, a second sheet cassette 203, a second sheet feed roller 204, and so forth. The first sheet cassette 201 and the second sheet cassette 203 each store a sheet bundle including a plurality of the recording sheets P serving as a recording member stacked on one another.

In the first sheet cassette 201 and the second sheet cassette 203, the first sheet feed roller 202 and the second sheet feed roller 204 are rotated so as to separate the recording sheet P from the sheet bundle one sheet at a time and send the recording sheet P to a sheet feed path.

In the vicinity of the end of the sheet feed path, a pair of registration rollers 28 is provided. The pair of registration rollers 28 nip the recording sheet P in the sheet feed path. Subsequently, transportation of the recording sheet P temporarily halts. The registration rollers 28 resume operation in appropriate timing such that the recording sheet P is aligned with the toner image formed on the photoreceptor 10. Subsequently, the recording sheet P is sent to a later-described transfer nip.

The scanner 300 provided above the printer unit 100 is configured to read a document image placed on a contact glass 301. The scanner 300 includes a light source 302*a* for illuminating a document, a first carriage 302 including a first reflective mirror 302*b*, a second carriage 303 including a second reflective mirror 303*a* and a third reflective mirror 303*b*, a focusing lens 304, an image sensor 305, and so forth.

The first carriage 302 moves along the direction of the document surface while illuminating the document on the contact glass 301 with light emitted from the light source 302*a* to scan and read the document.

After the scan light reflected from the document surface is reflected by the first reflective mirror 302*b*, the second reflective mirror 303*a*, and the third reflective mirror 303*b* of the second carriage 303, respectively, the scan light enters the image sensor 305 through the focusing lens 304.

The image sensor 305 includes a CCD and so forth, and generates an image signal based on the scan light entering the image sensor 305. The image signal is sent to a scan control unit, not shown, and digitalized. Based on the image signal after the digital processing, a scan control unit drives the optical scanning unit 50 of the printer unit 100. Subsequently, the optical scanning unit 50 optically scans the surface of the photoreceptor 10 to form an electrostatic latent image on the surface thereof.

In the printer unit 100, the peripheral surface of the photoreceptor 10, which is rotatably driven in the counter-clockwise direction, is uniformly evenly charged by the charger 11. Subsequently, the peripheral surface of the photoreceptor 10 is optically scanned by the optical scanning unit 50, thereby forming an electrostatic latent image on the surface of the photoreceptor 10. The electrostatic latent image is developed with toner supplied by a developing roller 12*a* of the developing unit 12 so as to form a visible image, that is, a toner image.

The sheet conveyance belt 20 endlessly moving at the side of the photoreceptor 10 is pressed against the surface of the photoreceptor 10 by a transfer roller 24 disposed inside the belt loop (inner side of the sheet conveyance belt 20). Accordingly, the photoreceptor 10 and the outer surface of the sheet conveyance belt 20 (outer peripheral surface of the loop) contact each other, forming a transfer nip. In the transfer nip, a transfer electric field is formed when the transfer roller 24 is supplied with a transfer bias.

The recording sheet P sent from the pair of the registration rollers 28 in the above-described manner tightly contacts the toner image on the photoreceptor 10 while being nipped by the transfer nip. The nip pressure and the transfer electric field transfer the toner image onto the recording sheet P.

The recording sheet P on which the toner image is transferred is transported along with the endless movement of the sheet conveyance belt 20 in a state in which the recording sheet P is adhered to the front surface of the sheet conveyance belt 20. Subsequently, the recording sheet P is transported to the fixing unit 6.

The fixing unit 6 includes a fixing roller and a pressure roller. The fixing roller, which has a built-in heat source, for example, a halogen lamp or the like, rotates while contacting the pressure roller which also rotates, thereby forming a fixing nip. After the recording sheet P is transported to the fixing unit 6 from the sheet conveyance belt 20, the recording sheet P is stacked on the sheet stack unit 8 via the pair of sheet discharge rollers 29.

Toner remaining on the surface of the photoreceptor 10 after the recording sheet P passes the transfer nip is removed from the surface of the photoreceptor 10 by the cleaning unit 13. Subsequently, the photoreceptor 10 is again uniformly evenly charged by the charger 11.

The foregoing describes one example of an image forming operation in which the document placed on the contact glass 301 is read by the scanner 300, and the image is formed based on the image information read by the scanner 300.

Alternatively, however, the image forming apparatus, i.e., a copier, according to the exemplary embodiment, may serve as a printer. In such a case, the printer unit 100 forms an image based on the image information sent from an external personal computer or the like.

Figure 2:
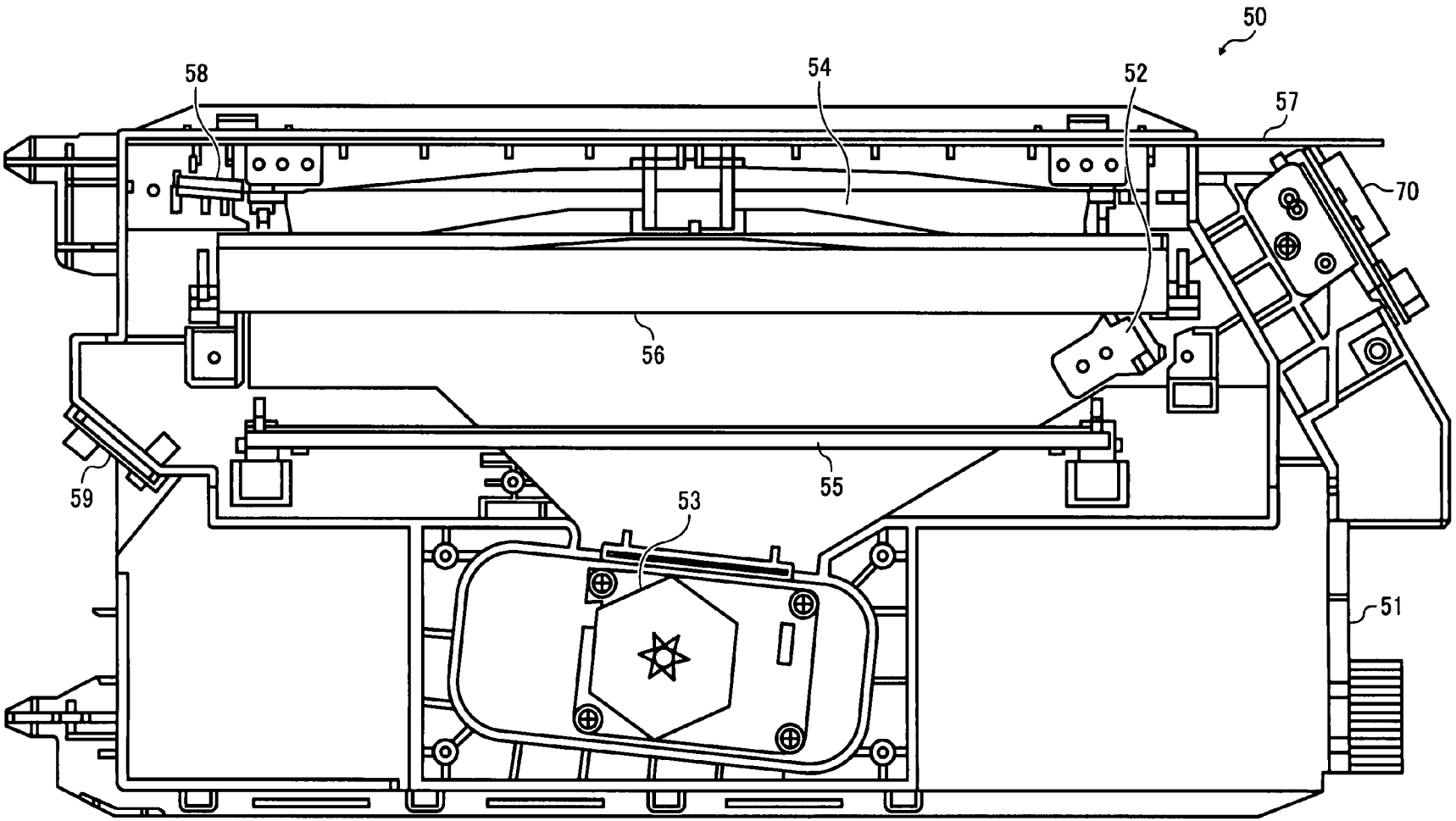
FIG. 2 is a schematic diagram illustrating an inner structure of an optical scanning apparatus of the image forming apparatus of FIG. 1 as viewed from the top, according to an exemplary embodiment of the present invention.

Referring now to FIG. 2, there is provided a schematic diagram illustrating an inner structure of the optical scanning unit 50 as viewed from the top thereof. The optical scanning unit 50 includes at least a housing 51 serving as a chassis of the optical scanning unit 50, a polygon mirror 53 formed to a hexahedron shape and having six mirror side faces, an fθ mirror 54, a reflective mirror 55, a correction lens 56 configured to correct optical face tangle error, and a dust-proof glass 57 configured to seal the optical scanning unit 50.

Figure 3:
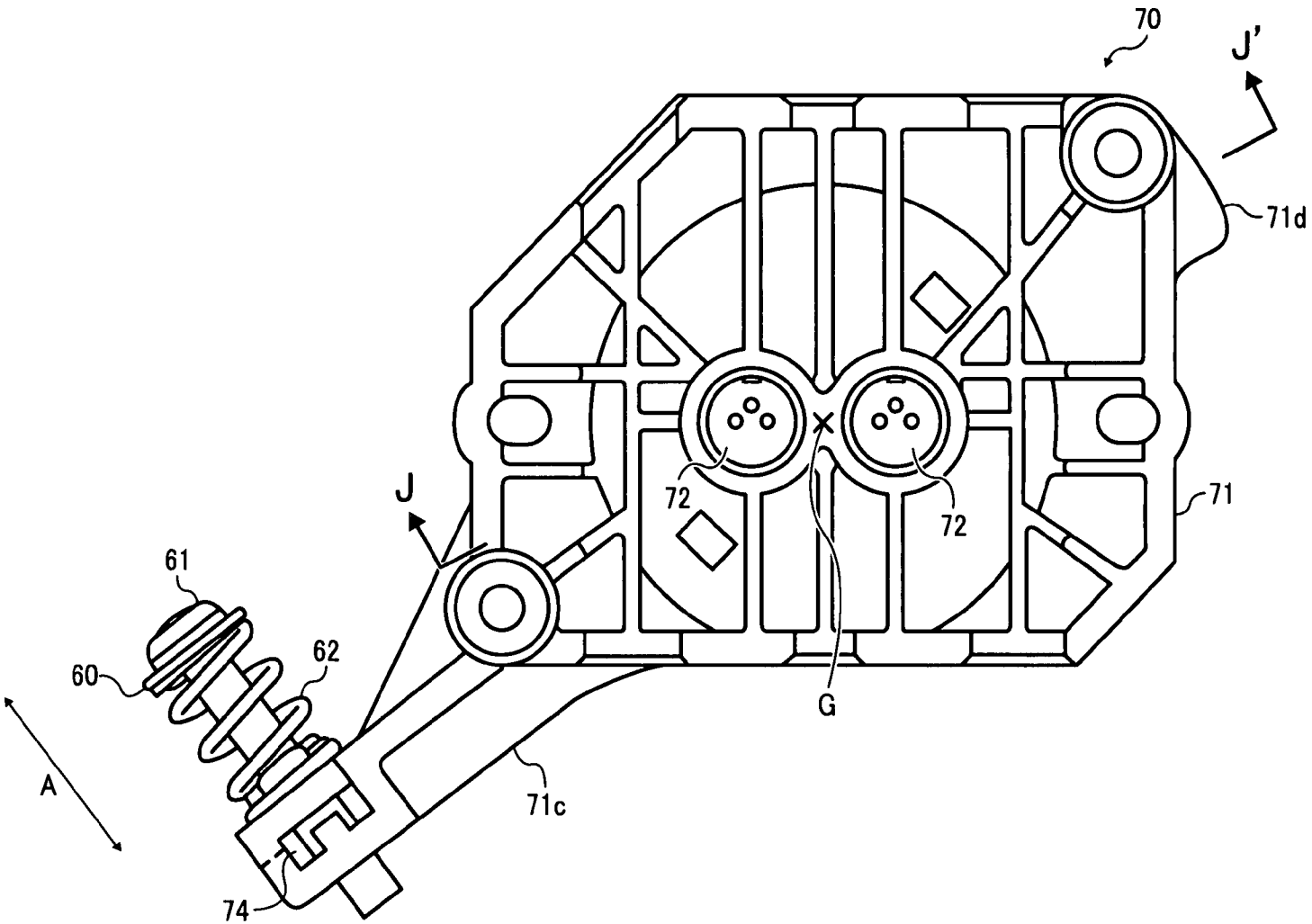
FIG. 3 is a front view illustrating an LD unit of the optical scanning apparatus of FIG. 2, according to an exemplary embodiment of the present invention.

A later-described semiconductor laser diode unit 70 (hereinafter referred to simply as "LD unit") is held at the side of the housing 51. A semiconductor laser diode (hereinafter referred to simply as "LD") serving as a light source is fixed to the LD unit 70 as illustrated in FIG. 3.

The light beam emitted from the LD passes through a collimator lens, not shown, of the LD unit 70, exits the LD unit 70, and subsequently enters the housing 51. The light beam is formed to a certain shape at an aperture, not shown, and passes through a cylindrical lens 52 so that the light beam is focused in a sub-scan direction, that is, a direction equivalent to the direction of the movement of the photoreceptor surface.

Next, the light beam is reflected by the mirror surface of any one of the six mirror faces of the polygon mirror 53 and deflected in the main scan direction, that is, a direction equivalent of an axis line direction on the photoreceptor surface. The light beam is deflected in the main-scan direction by the polygon mirror 53 at a constant angular velocity. Subsequently, the f-θ mirror 54 converts the traveling speed of the light beam in the deflection direction to a constant speed.

Subsequently, the light beam is directed outside the housing 51 via the fθ mirror 54, the reflective mirror 55, the correction lens 56, and the dust-proof glass 57, and reaches the surface of the photoreceptor, not shown in FIG. 2.

At the end portion of the correction lens 56 in the longitudinal direction, that is, to the left in FIG. 2, the light beam passed through the end portion reaches the reflective mirror 58 before reaching the dust-proof glass 57. Then, the light beam is reflected by the surface of the reflective mirror 58 and detected by a synchronous sensor 59 serving as an optical sensor. Based on the timing with which the synchronous sensor 59 detects the light beam, writing timing in the main scan direction is determined.

Figure 4:
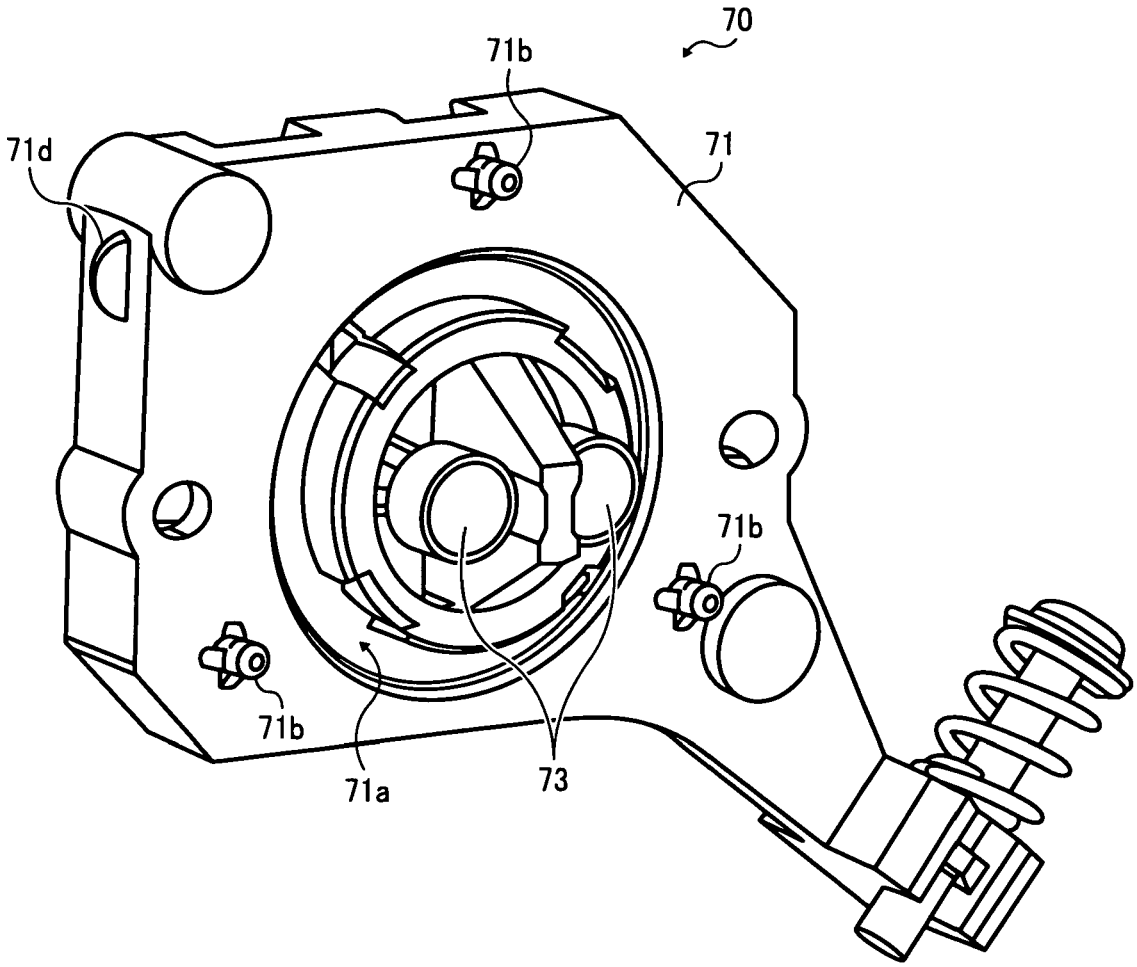
FIG. 4 is a perspective view illustrating the LD unit of FIG. 3 as viewed from the back thereof, according to an exemplary embodiment of the present invention.

Referring now to FIG. 3, there is provided a front view of the LD unit 70. FIG. 4 is an enlarged perspective view illustrating a back side (the side facing the housing 51) of the LD unit 70.

As illustrated in FIGS. 3 and 4, the LD unit 70 includes a substantially flat retaining member 71 serving as a light source retainer. The retaining member 71 includes two insertion holes penetrating through the retaining member 71 in a depth direction thereof. According to the exemplary embodiment, a plurality of laser diodes 72 (two laser diodes) is provided. The two laser diodes 72 (hereinafter referred to as LDs 72) are each press-fitted into the insertion holes as illustrated in FIG. 3.

In recent years, a high recording speed is desired for the image forming apparatus. One possible solution for achieving the high recording speed is to rotate the polygon mirror at high speed so that the scan speed in the main scan direction can be increased. However, such a configuration may cause the polygon motor to vibrate, generating noise and heat and damaging the motor.

Another possible solution for increasing the recording speed is to implement a so-called multi-beam method that uses a plurality of light beams, each of which simultaneously scans the surface of the photoreceptor.

The multi-beam method allows each of the plurality of the light beams to simultaneously scan, in the main scan direction, different positions of the photoreceptor surface of the sub-scan direction. Accordingly, the recording speed can be increased without excessively increasing the rotation speed of the polygon mirror.

According to the exemplary embodiment, the multi-beam method, in which two light beams emitted from the two LDS 72 simultaneously scan the surface of the photoreceptor, is used. In this method, there is a predetermined interval (hereinafter referred to as multi-beam pitch) between the scan positions of the light beams in the sub-scan position on the photoreceptor surface. The light beams scan the photoreceptor surface at the predetermined multi-beam pitch.

As illustrated in FIG. 4, two collimator lenses 73 are each fixed at the front of the two LDs 72. The position of the collimator lenses 73 is determined such that parallelism and the traveling direction of the optical axis of the two optical beams emitted from the LDs 72 can be optimized. Thereafter, the collimator lenses 73 are adhered to the retaining member 71.

On the back side of the retaining member 71, as illustrated in FIG. 4, a ring-shaped recessed portion 71*a* is formed so as to surround the two collimator lenses 73. Three cylindrical pins 71*b* are provided in a protruding manner from the back surface of the retaining member 71 outside the ring-shaped recessed portion 71*a*, each formed at a position 120 degrees away from each other relative to the ring center of the ring-shaped recessed portion 71*a*.

Figure 5:
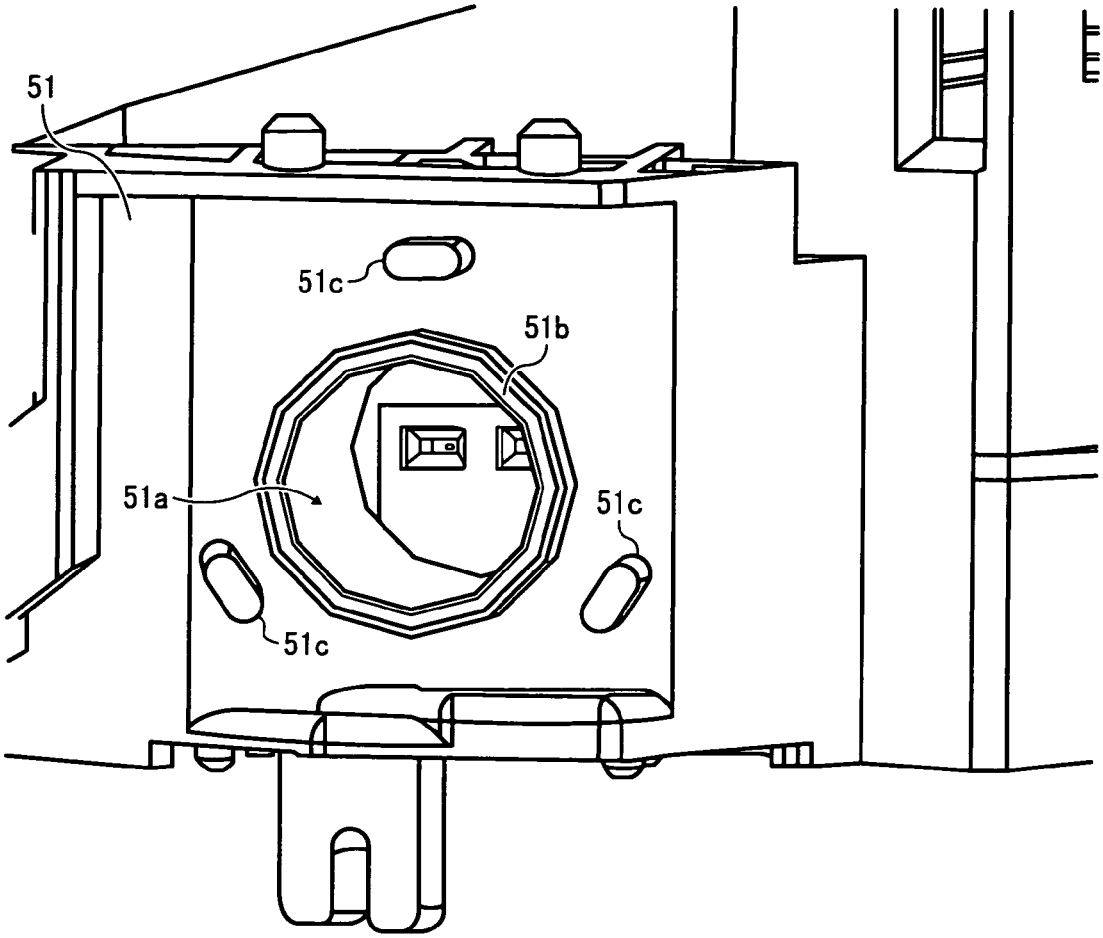
FIG. 5 is an enlarged perspective view illustrating a mounting portion of a housing of the optical scanning apparatus to which the LD unit is mounted, according to an exemplary embodiment of the present invention.

Referring now to FIG. 5, there is provided an enlarged perspective view illustrating a mounting portion of the housing 51 to which the LD unit 70 is mounted. The LD unit installation portion is provided on a lateral surface of the housing 51 and includes a circular opening 51*a*, an engaging member 51*b* cylindrically protruding from a periphery of the opening 51*a* on the lateral surface of the housing 51, three protrusions 51*c*, and so forth.

The opening 51*a* receives the two collimator lenses 73 which are slightly protruding from the back surface of the LD unit and directs the light beams into the housing 51.

As can be seen in FIGS. 4 and 5, the engaging member 51*b* engages the above-described ring-shaped recessed portion 71*a* formed on the back of the LD unit 70, thereby rotatably holding the LD unit 70.

Figure 6:
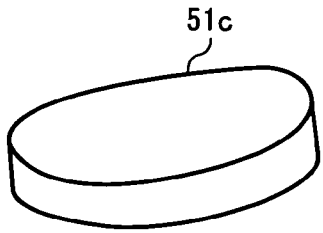
FIG. 6 is an enlarged perspective view illustrating one example of a protrusion of the housing of FIG. 5.

As illustrated in FIG. 6, the three protrusions 51*c* protrude a predetermined amount from the housing side surface. The protrusions 51*c* have a flat upper surface. The three pins 71*b* of the LD unit 70 each abut the protrusions 51*c*, thereby making it possible to set the position of the front ends of the LDs 72 in the optical axis direction relative to the housing 51.

According to the exemplary embodiment, as described above, the housing 51 serving as a holder rotatably holds the retaining member 71 serving as a light source retainer by the engaging member 51*b* which allows the retaining member 71 to detachably engage in the optical axis direction of the LDs 72.

As illustrated in FIG. 3, an arm 71*c* protrudes from the side surface of the retaining member 71 of the LD unit 70 in a direction perpendicular to the optical axis of the LDS 72. An internal thread portion, not shown, of a nut 74, engages the front end portion of the arm 71*c* in a tangent line direction shown by an arrow A relative to the rotation orbit of the main body 71.

A retainer bracket 60 is fixed on the side surface of the housing 51. External threads of a screw 61 are extendedly held in the above-described tangent line direction and fastened with the nut 74 secured at the front-end portion of the arm 71*c* of the retaining member 71 of the LD unit 70.

When changing a fastening amount of the screw 61 relative to the nut 74, the retaining member 71 rotates about a rotation axis or a rotation center G, accordingly. By adjusting the position of the retaining member 71 in the rotation direction, the multi-beam pitch on the photoreceptor surface, not illustrated, can be adjusted. It is to be noted that instead of using the nut 74, internal threads may be formed on the arm 71*c*.

A coil spring 62 is inserted into the external thread portion of the screw 61 and provided between the head of the screw 61 and the nut 74. Accordingly, the coil spring 62 exerts force on both the screw 61 and the nut 74, thereby reducing, if not preventing entirely, backlash of the bolt.

According to the exemplary embodiment, the retainer bracket 60, the screw 61, the nut 74, the coil spring 62 and so forth also serve as a lock mechanism which locks the retaining member 71 in place to keep it from rotating.

Furthermore, when the coil spring 62 biases the head of the screw 61 and the nut 74 in opposing directions, upon fastening the screw 61, a user can turn the screw 61 little by little with appropriate force, thereby allowing easy operation and reducing, if not preventing entirely, faulty operation. Fine adjustment of the sub-scan position of the scan line on the photoreceptor is enabled by rotating the main body 71. Still further, the resolution of the multi-beam pitch can be enhanced with a low-cost structure.

It is to be noted that instead of using the coil spring 62 as the resilient member, alternatively, the resilient member may be made of a resilient material such as rubber, or any other suitable resilient material.

On the side surface of the retaining member 71 of the LD unit 70 (the surface along the optical axis direction), a circular arc protrusion 71*d* is provided. The circular arc protrusion 71*d* is curved along the rotation direction of the retaining member 71 and protrudes in a direction perpendicular to the optical axis direction.

Figure 7:
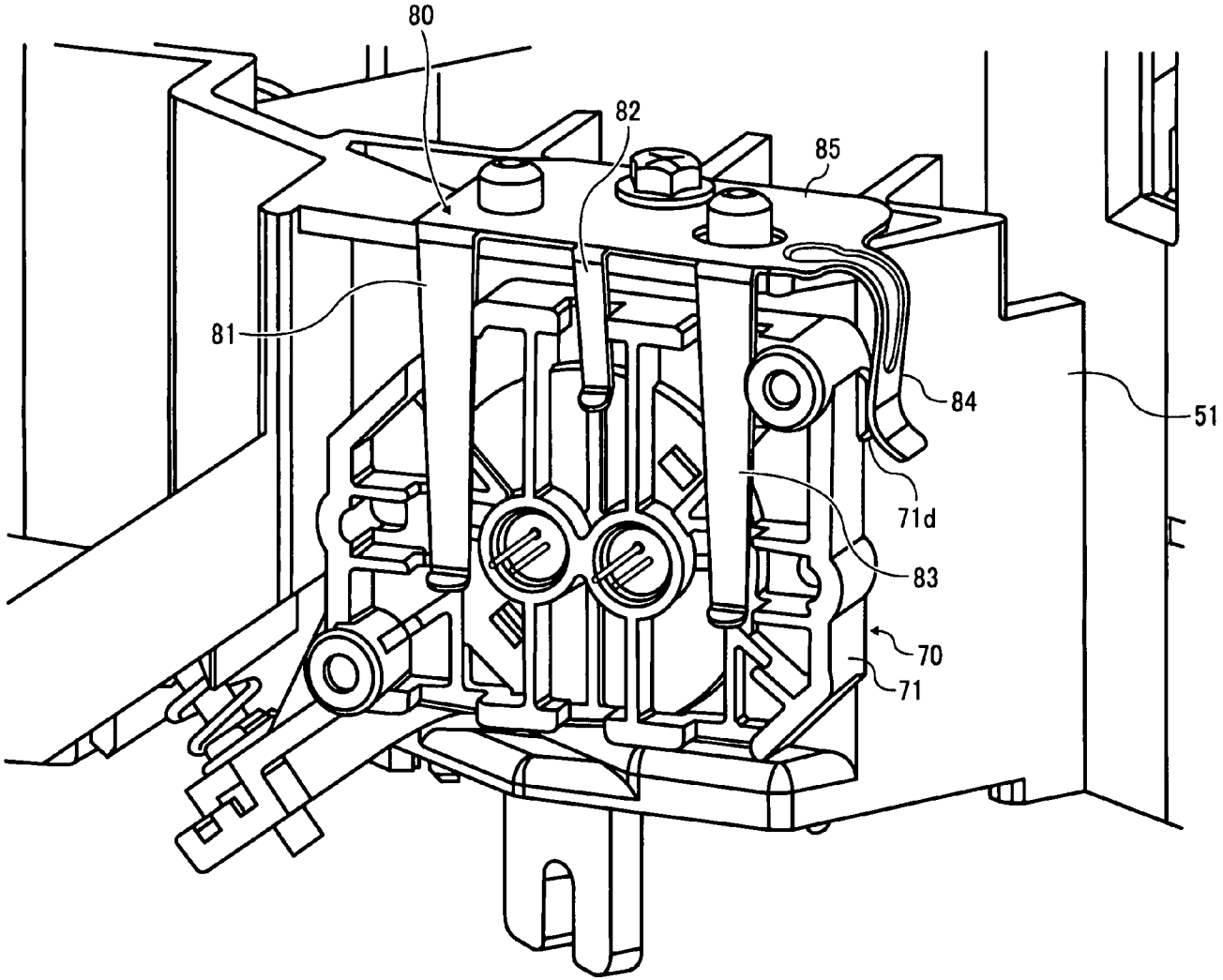
FIG. 7 is an enlarged perspective view illustrating the LD unit being held by the housing, according to an exemplary embodiment of the present invention.

Referring now to FIG. 7, there is provided an enlarged perspective view illustrating the LD unit 70 held at the side surface of the housing 51. On the upper surface of the retaining member 71, a leaf spring unit 80 is fixed thereto. The leaf spring unit 80 includes a base plate 85 on which a first front leaf spring 81, a second front leaf spring 82, a third front leaf spring 83, and a side leaf spring 84 are integrally formed.

The first front leaf spring 81, the second front leaf spring 82, and the third front leaf spring 83 are each bent at the fixed-end portion at approximately 90 degrees from the base plate 85 attached to the upper surface of the retaining member 71, and extend in the direction perpendicular to the optical axis, thereby biasing the front surface of the retaining member 71 toward the housing 51 in the optical axis direction.

Accordingly, the retaining member 71 movably held in the optical axis direction by the above-described engaging portion (the engaging member 51*b* of the housing 51 of FIG. 5) is pressed against the housing 51 in the optical axis direction, thereby preventing the retaining member 71 from falling off from the engaging portion.

The side leaf spring 84 of the leaf spring unit 80 is bent at the fixed-end portion at approximately 90 degrees from the base plate 85 attached to the upper surface of the retaining member 71, and extends in the direction perpendicular to the optical axis direction. The side leaf spring 84 biases the circular arc protrusion 71*d* provided on the side surface of the retaining member 71 in the direction perpendicular to the optical axis, thereby pressing the ring-shaped recessed portion 71*a* of the retaining member 71 of FIG. 4 against the cylindrical engaging portion of the housing 51 (the engaging member 51*b* of FIG. 5.) Accordingly, it is possible to reduce, if not prevent entirely, rattling of the retaining member 71 within the slight clearance between the ring-shaped recessed portion 71*a* and the engaging member 51*b*.

Figure 8:
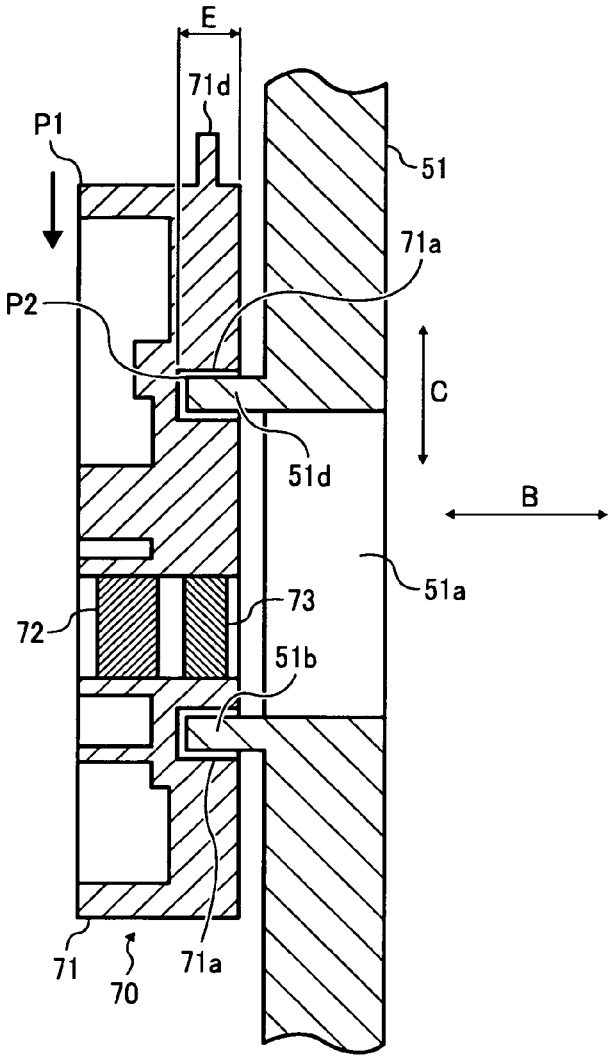
FIG. 8 is a cross-sectional view illustrating the LD unit of FIG. 3, taken along the line J-J', according to an exemplary embodiment of the present invention.

Referring now to FIG. 8, there is provided a cross-sectional view illustrating the LD unit 70 of FIG. 3 together with the housing 51 holding the retaining member 71 taken along a line J-J' shown in FIG. 3.

As can be seen in FIG. 8, a gap is formed between the rear surface of the retaining member 71 and the side surface of the housing 51. This is because the protrusions 51*c* of FIG. 5 protruding from the side surface of the housing 51 abut the protruding pins 71*b* of FIG. 4. Thus, the ring-shaped recessed portion 71*a* of the retaining member 71 and the engaging member 51*b* of the hosing 51 engage each other to a depth indicated by a reference character E in the optical axis direction shown by an arrow B in FIG. 8.

In FIG. 8, assuming that the contact surface of the side leaf spring 84 of FIG. 7 contacting the side surface of the retaining member 71 shifts off from the optical axis direction B due to manufacturing and/or assembly error, an end point P1 of the retaining member 71 may be biased at maximum by the side leaf spring 84, depending on the contact position of the side leaf spring 84 and the side surface of the retaining member 71 in the optical axis direction B.

Consequently, according to the principle of leverage, the force which causes the retaining member 71 to shift off from the optical axis direction B at the edge of the engaging member 51*b* as a fulcrum point P2 by a significant amount acts in the engaging area E. Thus, the retaining member 71 may easily shift off from the optical axis direction B.

However, according to the exemplary embodiment, the contact position of the side leaf spring 84 and the side surface of the retaining member 71 is configured to be within the engaging area E.

According to this configuration, even if the contact surface of the side leaf spring 84 relative to the retaining member 71 shifts off from the optical axis direction B, the portion of the contact surface which biases the retaining member 71 at maximum force remains within the engaging area E. Accordingly, the force causing the retaining member 71 to significantly shift from the optical axis direction B at the edge of the engaging member 51*b* as the fulcrum point P2 is negligible within the engaging area E, thereby making it possible to suppress displacement of the optical axis of the optical beam caused by manufacturing error and/or installation error of the side leaf spring 84.

Furthermore, according to the exemplary embodiment, as illustrated in FIG. 8, the circular arc protrusion 71*d* protruding from the side surface of the retaining member 71 is positioned in substantially the center of the engaging area E within which the engaging member 51*b* and the ring-shaped recessed portion 71*a* contact in the optical axis direction B.

According to this configuration, even if the surface of the side leaf spring 84 facing the retaining member 71 shifts off from the optical axis direction B due to manufacturing error and/or installation error, the end portion of the side leaf spring 84 in the optical axis direction B does not come into contact with the retaining member 71.

Instead, the center of the side leaf spring 84 in the optical axis direction B abuts the circular arc protrusion 71*d*, and is thus able to bias the retaining member 71 in substantially the center of the engaging area E regardless of manufacturing error and/or installation error of the side leaf spring 84, and to consistently suppress shifting of the retaining member 71 off from the optical axis direction B. Accordingly, the shift in the optical axis of the optical beam can be suppressed, thus preventing fluctuation of the multi-beam pitch.

Figure 9:
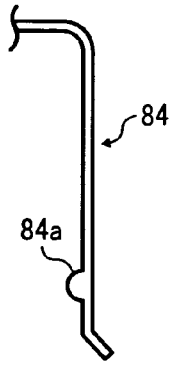
FIG. 9 is a side view illustrating a side leaf spring as viewed from a thickness direction thereof, according to an exemplary embodiment of the present invention.

The foregoing describes an example in which the side leaf spring 84 biases the circular arc protrusion 71*d* provided at the side surface of the retaining member 71. Alternatively, however, a similar if not the same effect can be achieved when a protrusion 84*a* is provided to the side leaf spring 84 as illustrated in FIG. 9. When the leaf spring 84 is fixed to the retaining member 71 such that the protrusion 84*a* is positioned overlapping the engaging area E illustrated in FIG. 8.

When the side leaf spring 84 biases the circular arc protrusion 71*d*, the contact area of the retaining member 71 contacting the leaf spring 84 can be reduced compared with a protrusion having a flat surface. Accordingly, the retaining member 71 can be biased more consistently in the direction shown by an arrow C perpendicular to the optical axis direction.

Figure 10:
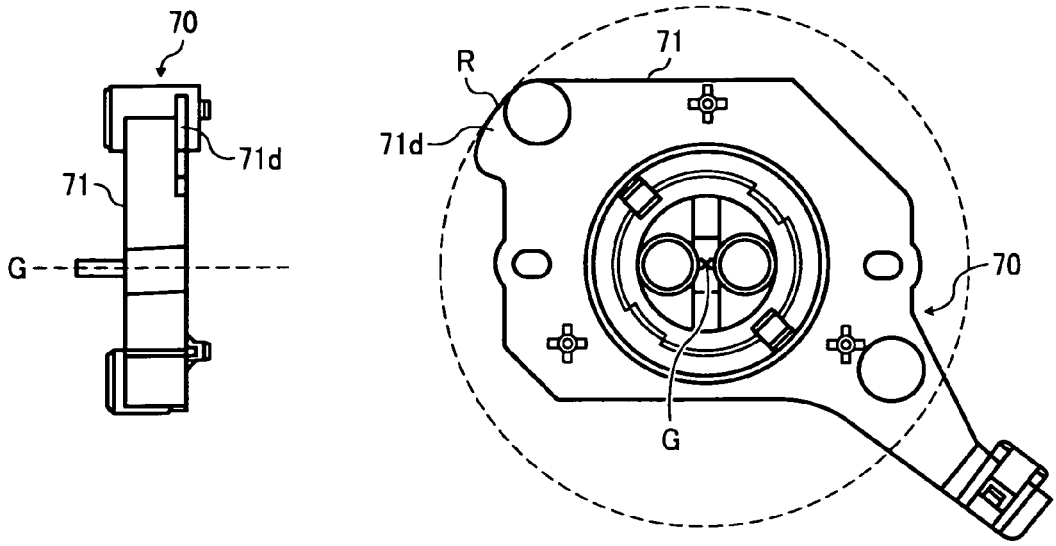
FIG. 10 is a conceptual diagram illustrating a center of curvature of a circular arc protrusion of the LD unit, according to an exemplary embodiment of the present invention.

As illustrated in FIG. 10, the surface R of the circular arc protrusion 71*d* provided to the retaining member 71 is biased by the side leaf spring 84. The center of the curvature of R is substantially the same as the center of rotation G of the retaining member 71.

According to this configuration, the distance between the point contact of the side leaf spring 84 and the circular arc protrusion 71*d*, and the center of rotation of the retaining member 71 can be maintained constant, regardless of the rotation angle of the retaining member 71. Thus, regardless of the rotation angle, the deformation amount of the side leaf spring 84 is maintained constant, thereby biasing the retaining member 71 at a constant force.

Figure 11:
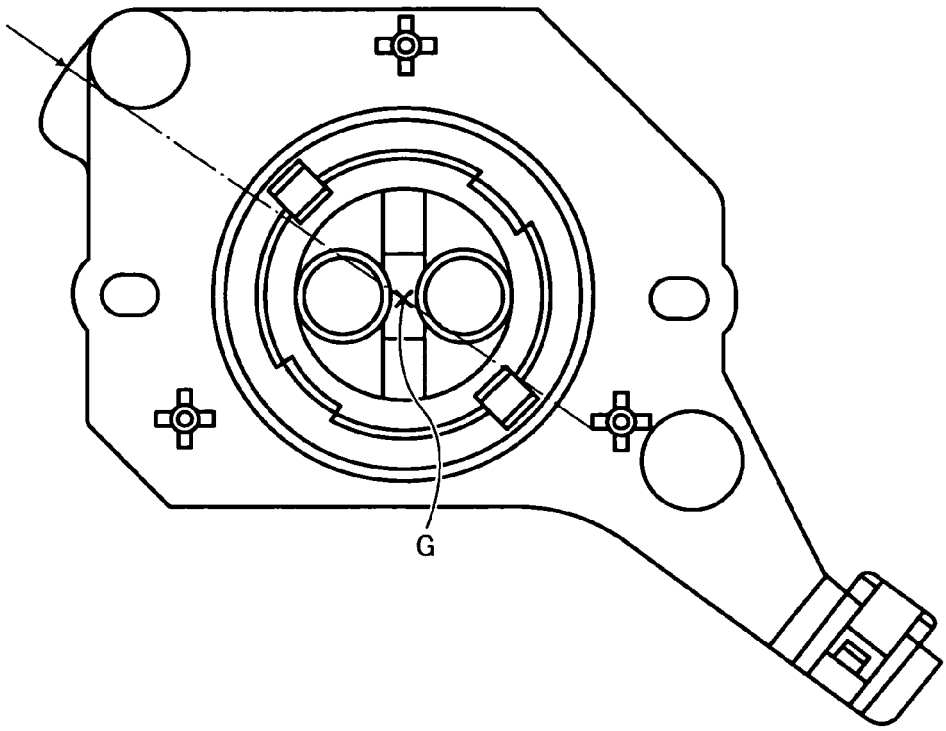
FIG. 11 is a conceptual diagram illustrating a bias direction of the side leaf spring, according to an exemplary embodiment of the present invention.

As illustrated in FIG. 11, according to the exemplary embodiment, the side leaf spring 84 biases the circular arc protrusion 71*d* in a direction shown by an arrow directed toward the center of rotation G of the retaining member 71, thereby pressing the peripheral surface of the ring-shaped recessed portion 71*a* relative to the circumferential surface of the cylindrical engaging member 51*b* in the normal direction. Accordingly, the ring-shaped recessed portion 71*a* is prevented from slipping away from the engaging member 51*b*, thereby making it possible to consistently engage the retaining member 71.

Figure 12:
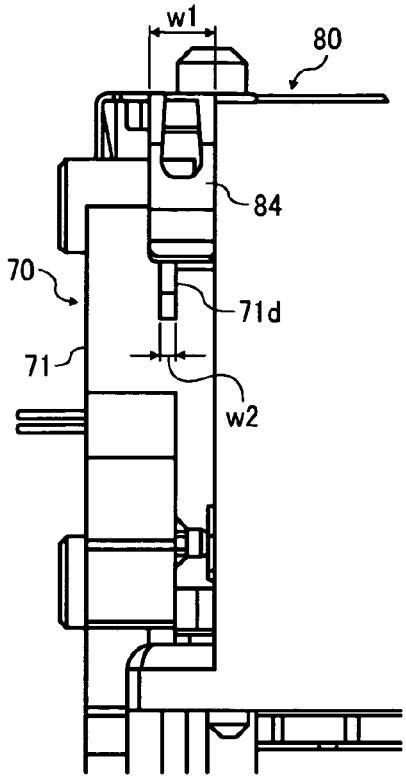
FIG. 12 is a side view illustrating the LD unit and a leaf spring unit, according to an exemplary embodiment of the present invention.

Referring now to FIG. 12, there is provided a side view illustrating the retaining member 71 of the LD unit 70 and the leaf spring unit 80. As illustrated in FIG. 12, the width W1 (the length in the optical axis direction) of the side leaf spring 84 of the leaf spring unit 80 is substantially greater than the thickness W2 (the length in the optical axis direction) of the circular arc protrusion 71*d*.

According to this configuration, even if there is manufacturing error and/or installation error of the side leaf spring 84 causing fluctuations in the relative position of the side leaf spring 84 relative to the circular arc protrusion 71*d* in the optical axis direction, it is still possible to consistently press the side leaf spring 84 against the circular arc protrusion 71*d*.

In FIG. 7, the retaining member 71 of the LD unit 70 is biased toward the housing 51 from the front by the front leaf springs 81, 82, and 83 of the leaf spring unit 80. As previously described, the protrusions 51*c* illustrated in FIG. 5 abut the tips of the cylindrical pins 71*b* of the retaining member 71 illustrated in FIG. 4. Accordingly, static friction acts between the protrusions 51*c* and the corresponding cylindrical pins 71*b* in the direction perpendicular to the optical axis direction.

To move the retaining member 71 in the direction perpendicular to the optical axis direction within the clearance requires that a force greater than the static friction be exerted in the direction perpendicular to the optical axis direction. According to the exemplary embodiment, the biasing force of the side leaf spring 84 is configured to be substantially greater than the sum of static friction between the three protrusions 51*c* and the respective cylindrical pins 71*b*.

Accordingly, the retaining member 71 can be consistently moved within the clearance by the side leaf spring 84, thereby enabling the retaining member 71 to abut the engaging member 51*b*.

Figure 13:
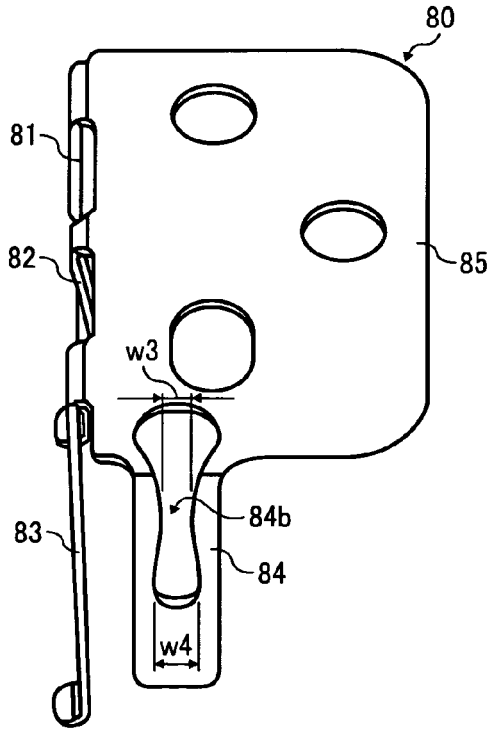
FIG. 13 is a cross-sectional view illustrating the leaf spring unit of FIG. 12, according to an exemplary embodiment of the present invention.

Referring now to FIG. 13, there is provided a perspective view illustrating the leaf spring unit 80. As described above, the image forming apparatus according to the exemplary embodiment uses the leaf spring unit 80 which includes the base plate 85 on which the side leaf spring 84 serving as the first biasing member and the three leaf springs 81 through 83 serving as the second biasing member are integrally formed. Accordingly, when compared with leaf springs independently formed, it is possible to reduce the cost of the spring and the installation cost.

However, according to this configuration, the thickness of each of the leaf springs is configured to be the same. Consequently, it may be difficult to adjust the biasing force by changing thickness thereof. In order to accommodate this difficulty, according to the exemplary embodiment, as illustrated in FIG. 13, a slit 84*b* is provided in substantially the center of the side leaf spring 84 in the width direction thereof (the center in the optical axis direction), extending from the fixed end to the free end of the leaf spring unit 80. Accordingly, without changing the thickness of the leaf springs, the biasing force (spring constant) of the side leaf spring 84 can be adjusted independently.

The width W4 of the slit 84*b* on the free end of the side leaf spring 84 is configured to be substantially greater than the width W3 of the fixed end thereof, thereby forming the cross-sectional area of the leaf spring 84 on the free end in the width direction to be substantially smaller than the cross-sectional area on the fixed end in the width direction. Accordingly, the free end of the leaf spring can be consistently supported at the fixed end, enhancing uniform bending moment in the longitudinal direction of the leaf spring.

The foregoing describes an example of fixing a plurality of the LDS 72 to the retaining member 71. Alternatively, however, the present invention according to the exemplary embodiment can be implemented with an LD unit using a single LD 72.

In this case, the shift in the retaining member 71 can be suppressed by the point contact of the circular arc protrusion 71*d* and the side leaf spring 84, thereby accurately maintaining a constant optical scan position in the sub-scan direction on the photoreceptor surface.

Furthermore, the light source is not limited to the LD 72, and alternatively, a light source generated using other methods or devices such as an LED can be used. Moreover, the image forming apparatus is not limited to a monochrome image forming apparatus, and the present invention according to the exemplary embodiment can be implemented in a color image forming apparatus.

Figure 14:
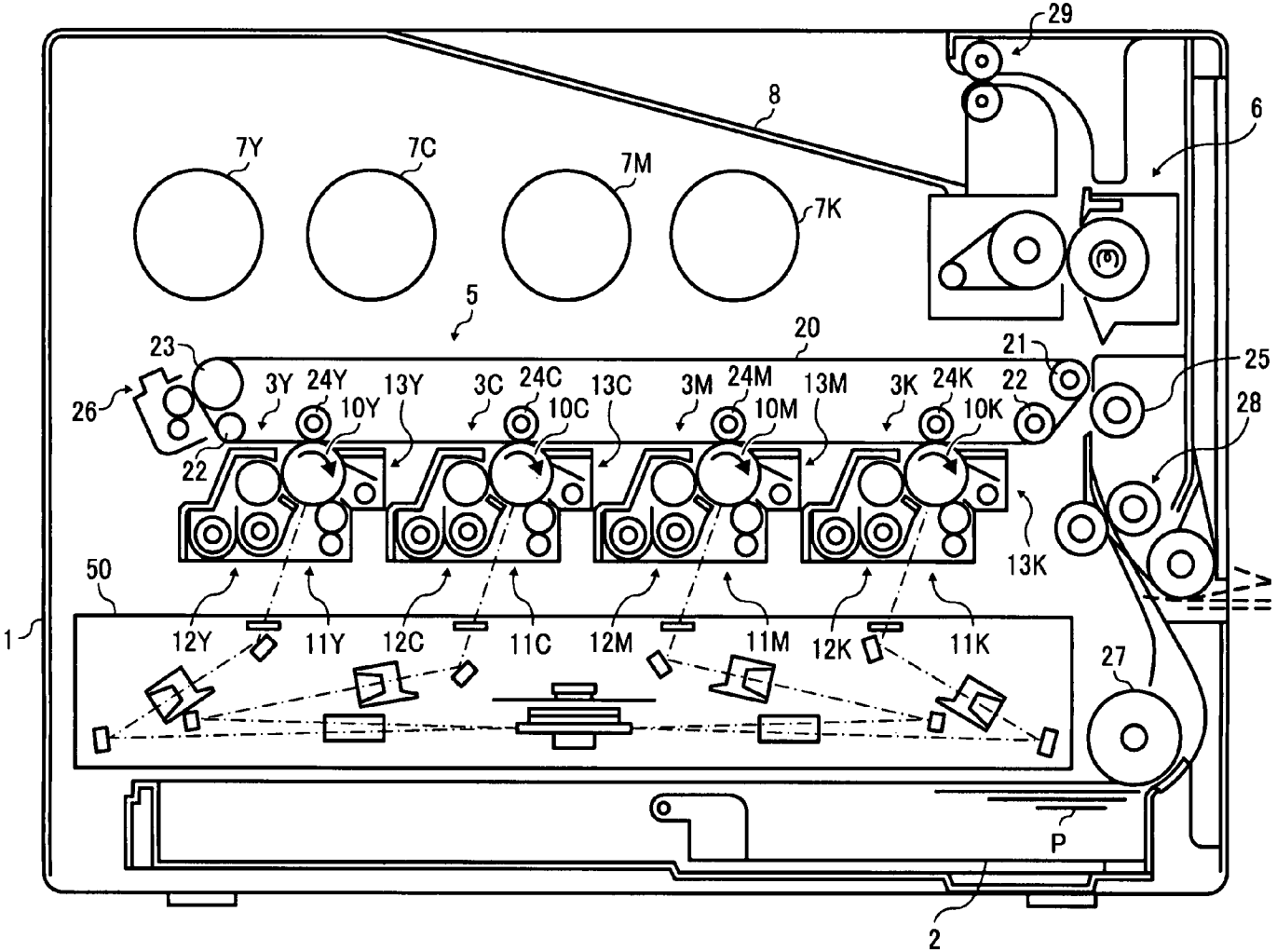
FIG. 14 is a schematic diagram illustrating a tandem-type color printer as an example of an image forming apparatus according to an exemplary embodiment of the present invention.
Figure 15:
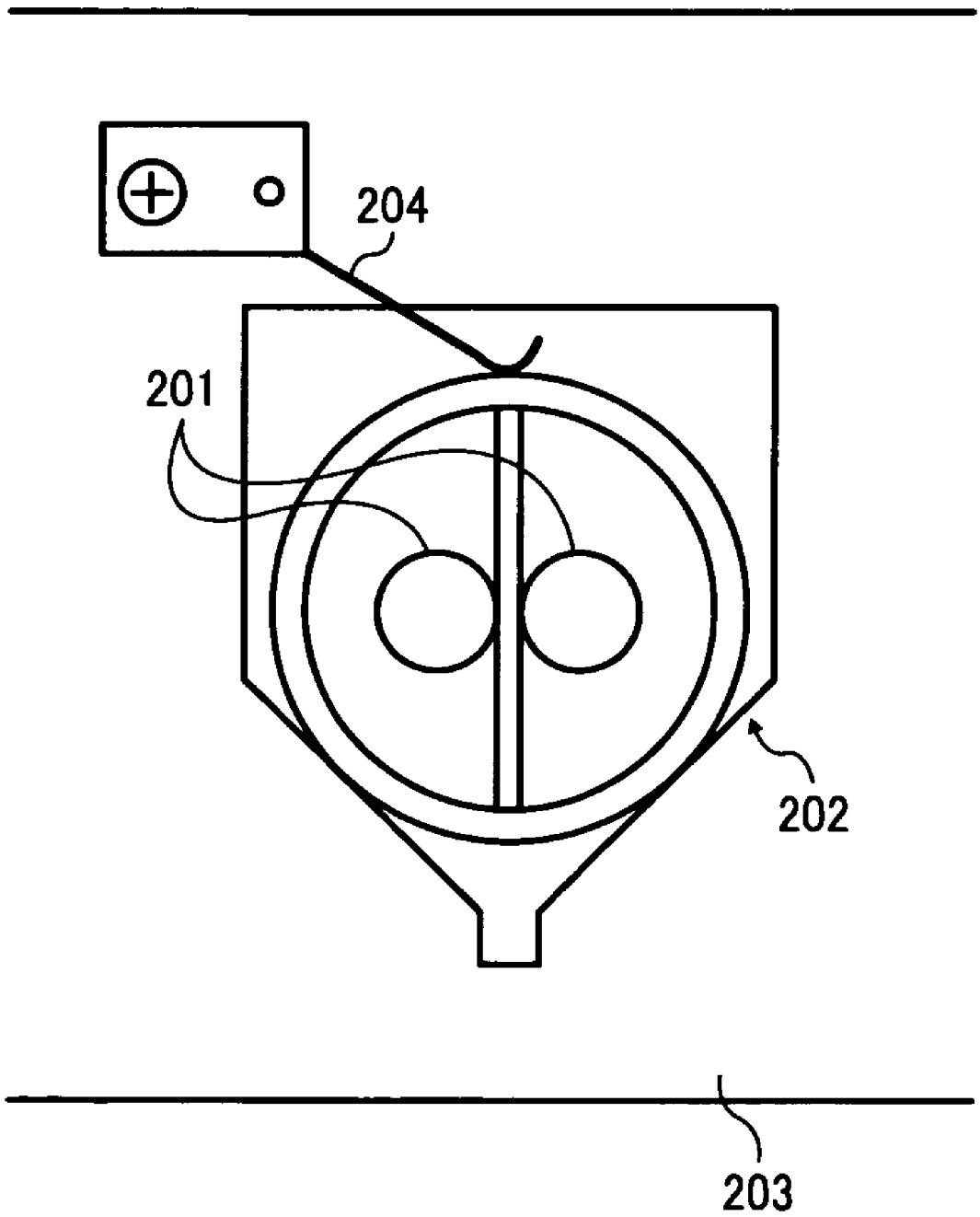
FIG. 15 PRIOR ART
FIG. 15 is a side view illustrating a light source retainer of a related art optical scanning apparatus.

Referring now to FIG. 14, there is provided a schematic diagram illustrating a tandem-type image forming apparatus, for example, a color printer according to one embodiment of the present invention.

The color printer according to the exemplary embodiment includes four process units 3Y, 3C, 3M, and 3K for forming toner images of yellow, cyan, magenta, and black, respectively.

The optical writing unit 50 independently scans photoreceptors 10Y, 10C, 10M, and 10K included in the process units 3Y, 3C, 3M, and 3K, respectively. In the process units 3Y, 3C, 3M, and 3K, the toner images of yellow (Y), cyan (C), magenta (M), and black (K) are formed on the respective photoreceptors 10Y, 10C, 10M, and 10K.

Subsequently, the toner images Y, C, M, and K are primarily overlappingly transferred on an intermediate transfer belt 20, and transferred onto the recording sheet P at once.

According to the exemplary embodiment, in each of LD units for yellow, cyan, magenta, and black, not shown, of the optical writing unit 50, shift of the light beams can be reduced, if not suppressed entirely, by the point contact of the circular arc protrusion and the side leaf spring. Accordingly, it is made possible to effectively reduce, if not suppressed entirely, shift of the optical scan lines for each color, thereby reducing, if not suppressing entirely, misalignment of colors overlapping on one another.

Furthermore, elements and/or features of different exemplary embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. An optical scanning apparatus, comprising:

a light source configured to emit a light beam which scans an object to be scanned;

a light source retainer configured to retain the light source;

a holder including an engaging portion configured to detachably hold the light source retainer in an optical axis direction of the light source; and a first biasing member configured to bias the light source retainer against the engaging portion of the holder in a direction perpendicular to the optical axis direction so that the light source retainer is pressed against the engaging portion of the holder, wherein a contact position where the light source retainer contacts the first biasing member in the optical axis direction is within an engaging area where the engaging portion of the holder and the light source retainer engage in the optical axis direction, the light source retainer includes a protrusion formed on a surface thereof, the protrusion protruding from substantially a center of the engaging area, and the first biasing member is arranged to press against the protrusion.

2. The optical scanning apparatus according to claim 1, further comprising:

a lock mechanism configured to lock rotation of the light source retainer, wherein the engaging portion is configured to engage the light source retainer such that the light source retainer is rotatable about a shaft parallel to the optical axis direction.

3. The optical scanning apparatus according to claim 2, wherein a contact portion of the protrusion of the light source retainer contacting the first biasing member has a curved surface.

4. The optical scanning apparatus according to claim 3, wherein a center of the curvature of the curved surface substantially coincides with a center of rotation of the light source retainer.

5. The optical scanning apparatus according to claim 2, further comprising:

a second biasing member, different from the first biasing member, configured to bias the light source retainer in the optical axis direction so as to press the light source retainer against the holder.

6. The optical scanning apparatus according to claim 5, wherein the first biasing member and the second biasing member are integrally formed on a base member.

7. The optical scanning apparatus according to claim 6, wherein a biasing direction of the first biasing member is a direction toward the center of rotation of the light source retainer.

8. The optical scanning apparatus according to claim 6, wherein the first biasing member is a leaf spring including a slit in substantially the center thereof in the optical axis direction and extending from a fixed-end portion of the leaf spring to a free-end portion of the leaf spring.

9. The optical scanning apparatus according to claim 8, wherein the length of the slit at the free-end portion thereof in the optical axis direction is greater than the length of the slit at the fixed-end portion in the optical axis direction.

10. The optical scanning apparatus according to claim 5, a biasing force exerted by the first biasing member is greater than a static frictional force acting between the holder and the light source retainer pressed against the holder by the second biasing member.

11. The optical scanning apparatus according to claim 2, wherein the first biasing member is a leaf spring having a length in the optical axis direction greater than a length of the protrusion in the optical axis direction.

12. The optical scanning apparatus according to claim 2, wherein the light source is configured as a plurality of the light sources provided to the light source retainer, configured to emit a plurality of light beams each aligned in the sub-scan direction on a surface of an object to be scanned and deflected in a main-scan direction, the plurality of the light beams simultaneously scanning the surface of the object to be scanned.

13. The optical scanning apparatus according to claim 1, wherein the light source is a semiconductor laser diode.

14. The optical scanning apparatus according to claim 1, wherein the light source retainer includes a ring-shaped recess portion into which the engaging member of the holder is inserted.

15. The optical scanning apparatus according to claim 14, wherein the engaging area is an area of contact between surfaces of the ring-shaped recess portion and surfaces of the engaging member.

16. The optical scanning apparatus according to claim 14, wherein the light source retainer includes a plurality of protrusions configured to abut against a plurality of protrusions on the holder to form a gap between the light source retainer and the holder.

17. An image forming apparatus for forming an image, comprising:

a latent image bearing member configured to bear a latent image thereon;

a developing unit configured to develop the latent image on the latent image bearing member; and an optical scanning apparatus configured to form the latent image on the latent image bearing member by optically scanning the surface of the image bearing member, the optical scanning apparatus including:

a light source configured to emit the light beam;

a light source retainer configured to retain the light source;

a holder including an engaging portion configured to detachably hold the light source retainer in an optical axis direction of the light source; and a first biasing member configured to bias the light source retainer against the engaging portion of the holder in a direction perpendicular to the optical axis direction so that the light source retainer is pressed against the engaging portion of the holder, wherein a contact position where the light source retainer contacts the first biasing member in the optical axis direction is within an engaging area where the engaging portion of the holder and the light source retainer engage in the optical axis direction, the light source retainer includes a protrusion formed on a surface thereof, the protrusion protruding from substantially a center of the engaging area, and the first biasing member is arranged to press against the protrusion.

18. The image forming apparatus according to claim 17, wherein the light source retainer includes a ring-shaped recess portion into which the engaging member of the holder is inserted.

19. The image forming apparatus according to claim 18, wherein the engaging area is an area of contact between surfaces of the ring-shaped recess portion and surfaces of the engaging member.

20. The image forming apparatus according to claim 18, wherein the light source retainer includes a plurality of protrusions configured to abut against a plurality of protrusions on the holder to form a gap between the light source retainer and the holder.

* * * * *